US006138536A

United States Patent [19]

Chen

[11] Patent Number: 6,138,536

[45] Date of Patent: Oct. 31, 2000

[54] SCREW DRIVING GUN WITH A SCREW ORIENTATION GUIDE MEMBER

[76] Inventor: Sen-Yang Chen, No. 155, Huei-Min St., Nan-Tzu Dist., Kaohsiung City, Taiwan

[21] Appl. No.: 09/280,425

[22] Filed: Mar. 29, 1999

[51] Int. Cl.[7] ..... B25B 23/04

[52] U.S. Cl. ..... 81/434; 81/57.37

[58] Field of Search ..... 81/434, 57.37, 81/57.42, 57.44

[56] References Cited

U.S. PATENT DOCUMENTS

| | | | |
|---|---|---|---|
| 2,570,164 | 10/1951 | Shaff | 81/57.42 |
| 4,428,261 | 1/1984 | Takatsu et al. | 81/434 |
| 5,660,090 | 8/1997 | Deri | 81/434 |
| 5,791,207 | 8/1998 | Ahdoot | 81/57.37 |
| 5,862,724 | 1/1999 | Arata et al. | 81/434 |
| 5,974,918 | 11/1999 | Nakagawa et al. | 81/434 |

*Primary Examiner*—Stephen F. Gerrity
*Assistant Examiner*—Hadi Shakeri
*Attorney, Agent, or Firm*—Trop, Pruner & Hu, P.C.

[57] ABSTRACT

A screw driving gun includes a tubular barrel extending frontwardly from a gun housing to define a chamber in a longitudinal direction, and a tubular slider coupled slidably to a front end of the barrel. A front portion of the tubular slider has two opposing slots in the longitudinal direction for passage of a screw feed belt therethrough in order to register a screw on the feed belt with the chamber of the barrel. A screw orientation guide member is connected to the slider, and has a front section formed with an abutting end for abutting against a work piece surface, and a plurality of holding units cooperatively confining a guide passage in the longitudinal direction between the slider and the abutting end. The guide passage tapers to form a constricted front end proximate to the abutting end. The holding units cooperatively provide radial inward holding forces on the screw to prevent the latter from deviating from the longitudinal direction. A screw driving shaft is disposed in the chamber, and has a turning bit extendible into the slider for rotating the screw.

3 Claims, 5 Drawing Sheets

SCREW DRIVING GUN WITH A SCREW ORIENTATION GUIDE MEMBER

FIELD OF THE INVENTION

The invention relates to a screw driving gun, more particularly to a screwing driving gun with a screw orientation guide member.

BACKGROUND OF THE INVENTION

Referring to FIGS. 1 and 2, a conventional screw driving gun 1 is shown to be adapted for use with a screw feed belt 140 that has a belt body 141 and a plurality of screws 142 retained on the belt body 141, and includes a gun housing 11, a tubular barrel 12, a tubular slider 14, a screw driving shaft 13, and a positioning member 15.

As illustrated, the tubular barrel 12 has a first circumferential wall 120 with a rear end 121 mounted on the gun housing 11, and an opposite front end 122. The first circumferential wall 120 defines a chamber 120C in a longitudinal direction. The tubular slider 14 has a second circumferential wall 144 with a rear portion 145 that is coupled slidably to the front end 122 of the barrel 12 so as to be slidable relative thereto in the longitudinal direction, and a front portion 146 that extends forwardly of the barrel 12. The front portion 146 of the slider 14 is formed with two opposing slots 147 that extend in the longitudinal direction and that are adapted for passage of the belt body 141 therethrough in order to register a selected one of the screws 142 with the chamber 120C of the barrel 12. The screw driving shaft 13 has a driven end 131 and a turning bit 132 opposite to the driven end 131. The screw driving shaft 13 is accommodated in the chamber 120C of the barrel 12 such that the turning bit 132 is extendible into the tubular slider 14. The screw driving shaft 13 is rotatable axially such that the turning bit 132 is adapted to drive rotatably the selected one of the screws 142. A drive unit (not visible) is mounted in the gun housing 11, and is coupled to the driven end 131 of the screw driving shaft 13 so as to drive rotatably the screw driving shaft 13. The positioning member 15 is secured to the front portion 146 of the tubular slider 14 for abutting against surface 170 of a work piece 17 that rests on a wall structure 18 so that the work piece 17 can be fastened on the wall structure 18 when the selected one of the screws 142 is driven and rotated by the turning bit 132 upon operation of the driving unit.

A disadvantage of the conventional screw driving gun 1 resides in that, in case the selected screw 142 is of a relative long length in the longitudinal direction, the belt body 141 is unable to maintain the orientation of the screw 142 in the longitudinal direction. Thus, deviation of the screw 142 relative to the longitudinal direction (shown in dotted lines in FIG. 2) will occur during the driving operation of the screw 142.

SUMMARY OF THE INVENTION

Therefore, the object of this invention is to provide a screw driving gun with a screw orientation guide member to overcome the aforesaid disadvantage that is generally associated with the conventional screw driving gun.

The screw driving gun of the present invention is adapted for use with a screw feed belt that includes a belt body and a plurality of screws retained on the belt body. The screw driving gun, accordingly, includes a gun housing, a tubular barrel, a tubular slider, a screw driving shaft, a drive unit, and a tubular screw orientation guide member. The tubular barrel has a first circumferential wall with a rear end mounted on the gun housing, and an opposite front end. The first circumferential wall defines a chamber in a longitudinal direction. The tubular slider has a second circumferential wall with a rear portion that is coupled slidably to the front end of the barrel so as to be slidable relative thereto in the longitudinal direction, and a front portion that extends forwardly of the barrel. The front portion is formed with two opposing slots that extend in the longitudinal direction and that are adapted for passage of the belt body therethrough in order to register a selected one of the screws with the chamber of the barrel. The screw driving shaft has a driven end and a turning bit opposite to the driven end. The screw driving shaft is accommodated in the chamber of the barrel such that the turning bit is extendible into the tubular slider. The screw driving shaft is rotatable axially such that the turning bit is adapted to drive rotatably the selected one of the screws. The drive unit is mounted in the gun housing, and is coupled to the driven end of the screw driving shaft so as to drive rotatably the screw driving shaft. The screw orientation guide member has a third circumferential wall with a rear section connected to the front portion of the second circumferential wall, and a front section formed with an abutting end for abutting against a work piece surface. The screw orientation guide member further has a plurality of holding units which cooperatively confine a guide passage that extends in the longitudinal direction between the slider and the abutting end, and that is tapered in the longitudinal direction to form a constricted front end proximate to the abutting end and a wider rear end opposite to the constricted front end. The holding units are adapted to provide radial inward holding forces on the selected one of the screws to prevent the selected one of the screws from deviating from the longitudinal direction when the selected one of the screws extends into the guiding passage while being driven rotatably into the work piece surface by the turning bit of the screw driving shaft.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
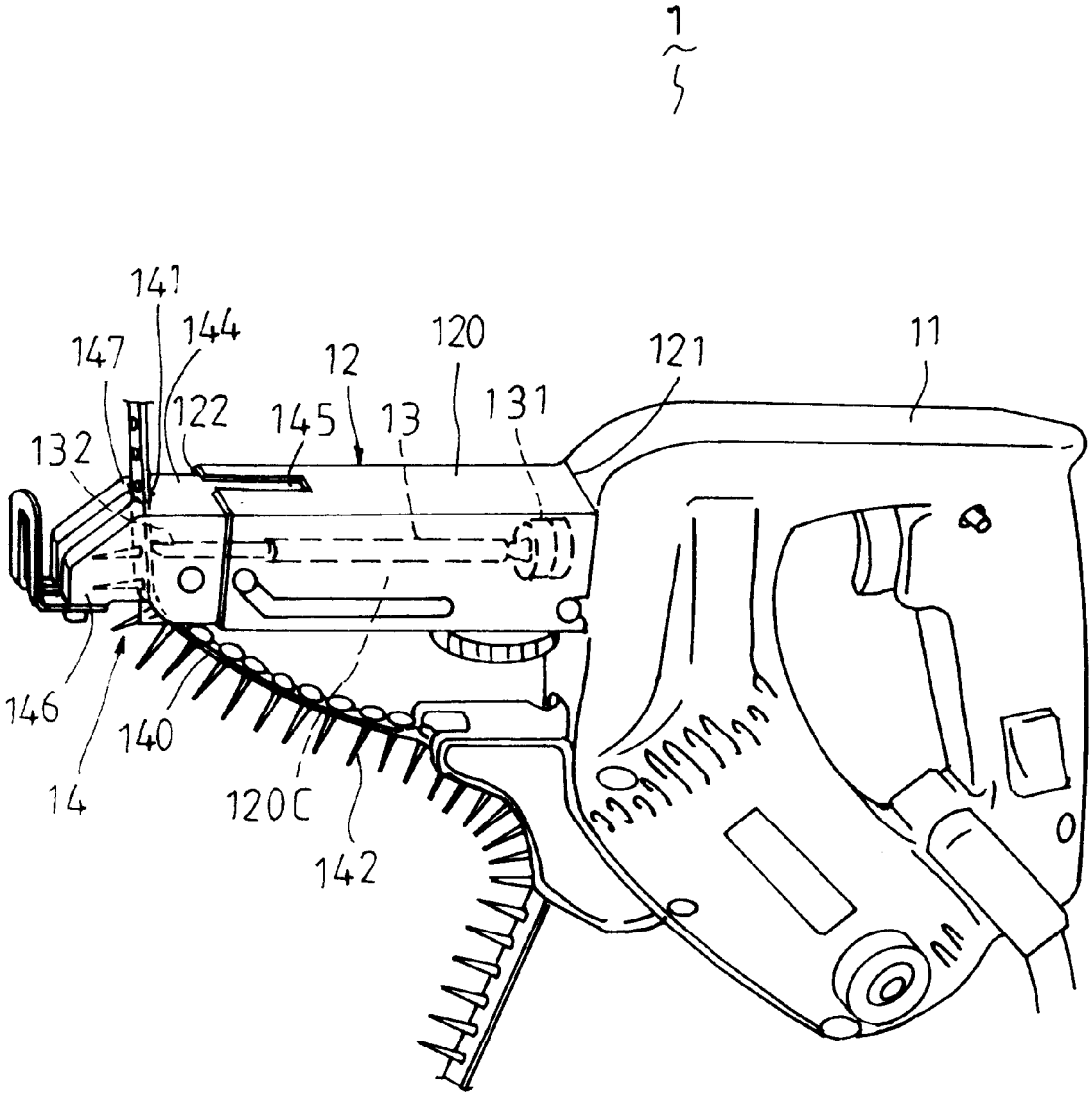
FIG. 1 PRIOR ART
FIG. 1 is a perspective view of a conventional screw driving gun.
Figure 2:
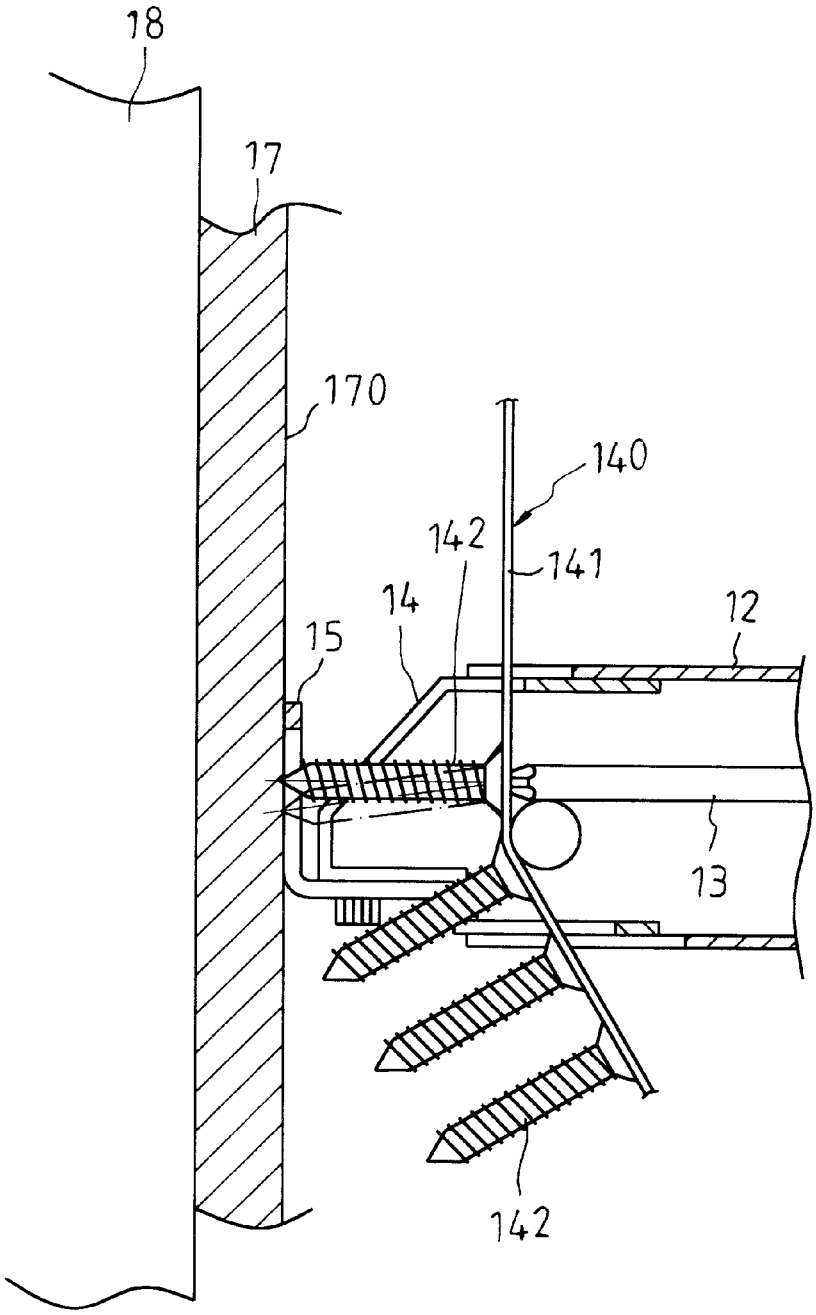
FIG. 2 PRIOR ART
FIG. 2 illustrates the conventional screw driving gun in use.
Figure 3:
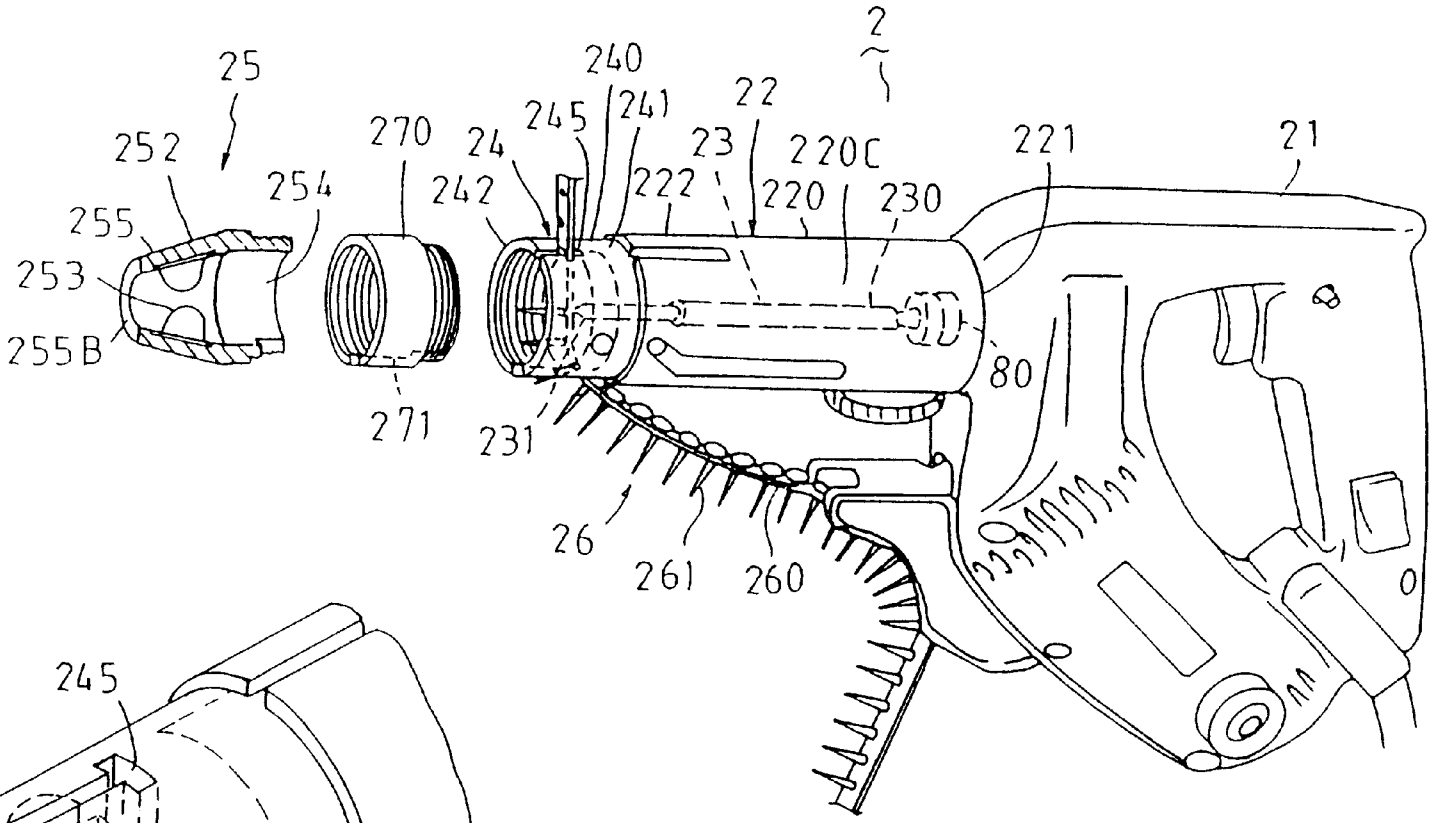
FIG. 3 is a partly exploded and perspective view of a preferred embodiment of a screw driving gun according to this invention.
Figure 3A:
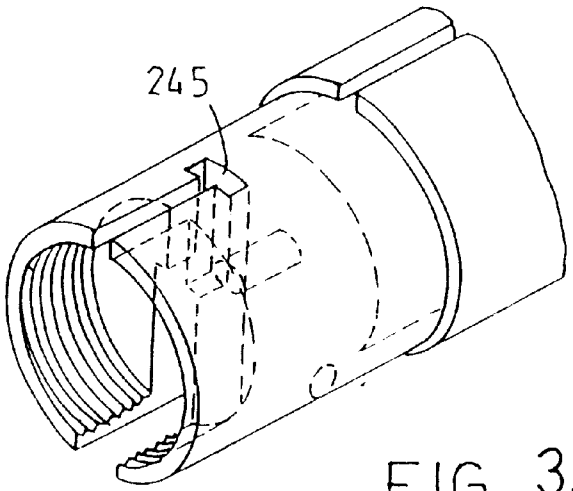
FIG. 3(A) is an enlarged perspective view of an encircled portion of FIG. 3 to illustrate a tubular slider of the preferred embodiment.
Figure 4:
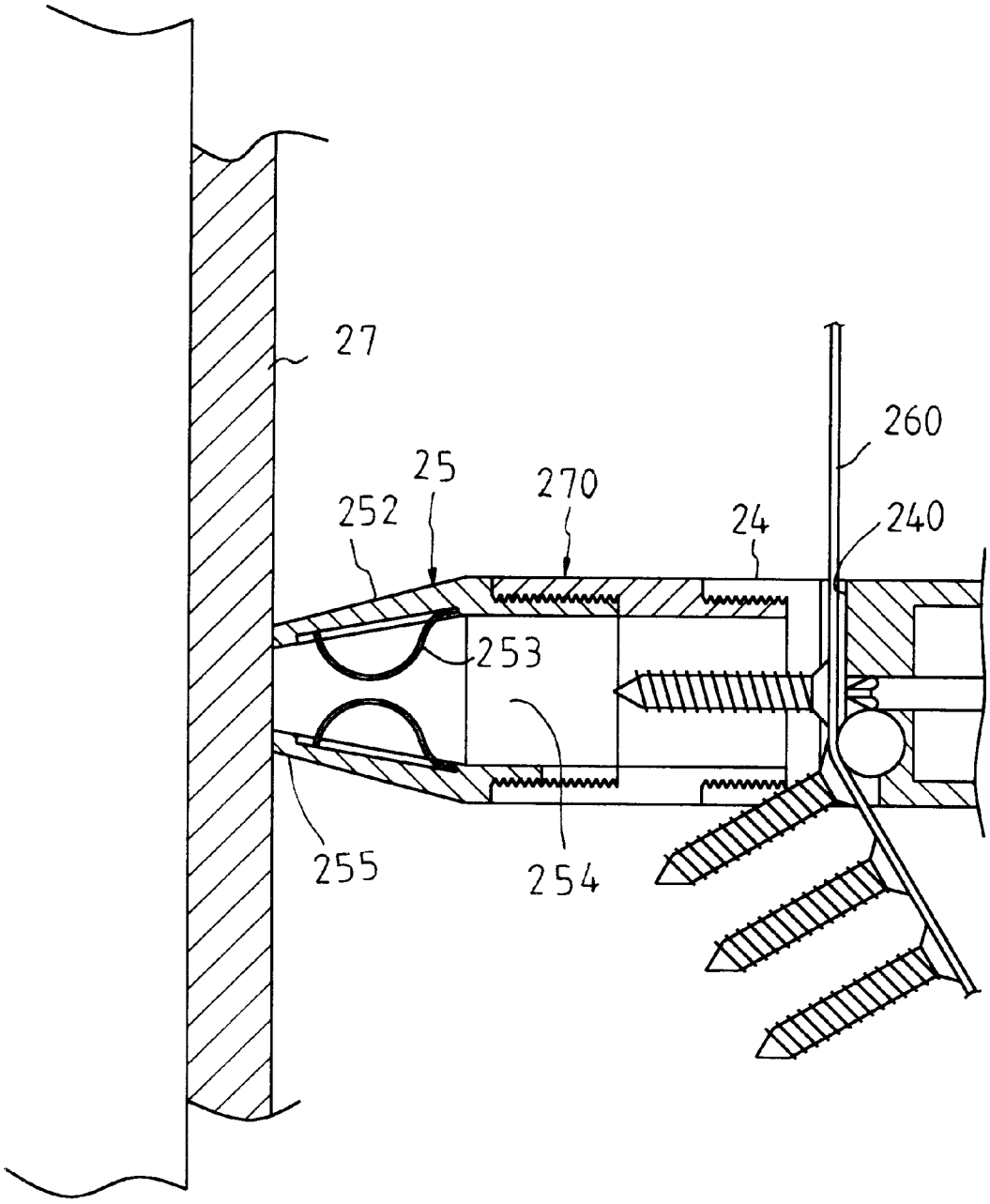
FIG. 4 is a fragmentary sectional view illustrating a screw orientation guide member employed in the preferred embodiment.

Referring to FIGS. 3, 3(A) and 4, the preferred embodiment of a screw driving gun 2 of the present invention is adapted for use with a screw feed belt 26 that includes a belt body 260 and a plurality of screws 261 retained on the belt body 260. The preferred embodiment, accordingly, includes a gun housing 21, a tubular barrel 22, a tubular slider 24, a screw driving shaft 23, a drive unit 80, and a tubular screw orientation guide member 25.

As illustrated, the tubular barrel 22 has a first circumferential wall 220 with a rear end 221 mounted on the gun housing 21, and an opposite front end 222. The first circumferential wall 220 defines a chamber 220C in a longitudinal direction. The tubular slider 24 has a second circumferential wall 240 with a rear portion 241 that is coupled slidably to the front end 222 of the barrel 22 so as to be slidable relative thereto in the longitudinal direction, and a front portion 242 that extends forwardly of the barrel 22. The front portion 242 of the slider 24 is formed with two opposing slots 245 that extend in the longitudinal direction and that are adapted for passage of the belt body 260 therethrough in order to register a selected one of the screws 261 with the chamber 220C of the barrel 22. As to how the tubular slider 24 is coupled to the barrel 22, that is known in the art and is not the subject of the present application. The screw driving shaft 23 has a driven end 230 and a turning bit 231 opposite to the driven end 230. The screw driving shaft 23 is accommodated in the chamber 220C of the barrel 22 such that the turning bit 231 is extendible into the tubular slider 24. The screw driving shaft 23 is rotatable axially such that the turning bit 231 is adapted to drive rotatably the selected one of the screws 261. The drive unit 80 is mounted in the gun housing 21 and is coupled to the driven end 230 of the screw driving shaft 23 so as to drive rotatably the screw driving shaft 23.

Figure 5:
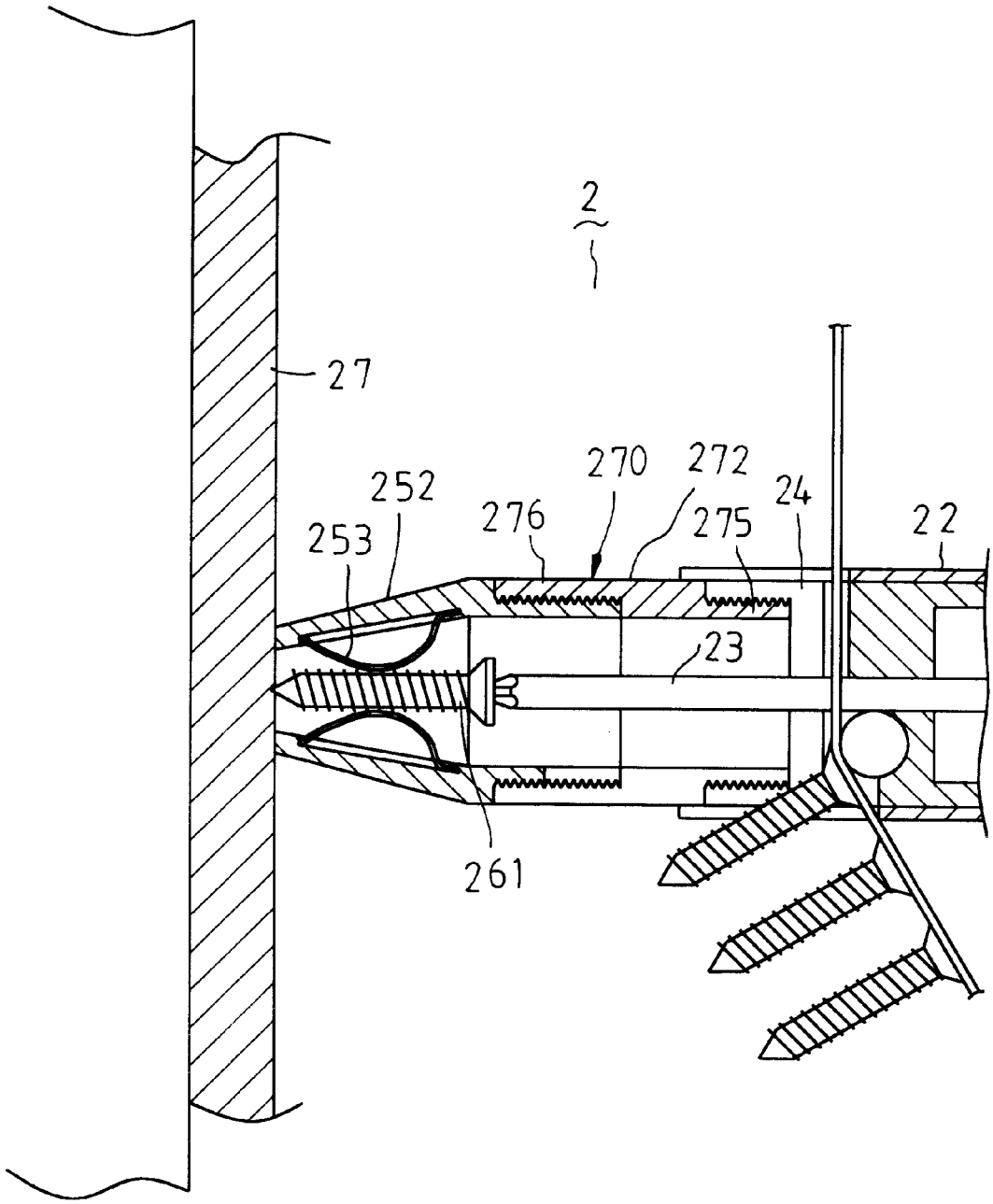
FIG. 5 is a fragmentary sectional view of the screw orientation guide member of the preferred embodiment, illustrating how a screw is guided to prevent the same deviating from a longitudinal line.

The screw orientation guide member 25 has a third circumferential wall 252 with a rear section 254 connected to the front portion 242 of the second circumferential wall 240, and a front section 255 formed with an abutting end 255B for abutting against a surface of a work piece 27. The screw orientation guide member 25 further has a plurality of holding units 253 which cooperatively confine a guide passage that extends in the longitudinal direction between the slider 24 and the abutting end 255B, and that is tapered in the longitudinal direction to form a constricted front end proximate to the abutting end 255B and a wider rear end opposite to the constricted front end. Preferably, the holding units 253 are in the form of longitudinal strips with two opposite ends, and are disposed in axially extending grooves formed in an inner surface of the third circumferential wall 252 proximate to the abutting end 255B. The holding units 253 are adapted to provide radial inward holding forces on the selected one of the screws 261 to prevent the latter from deviating from the longitudinal direction when the selected one of the screws 261 extends into the guiding passage while being driven rotatably into the surface of the work piece 27 (see FIG. 5) by the turning bit 231 of the screw driving shaft 23.

In the preferred embodiment, the rear section 254 of the third circumferential wall 252 is connected removably to the front portion 242 of the second circumferential wall 240. Preferably, the rear section 254 of the third circumferential wall 252 is formed with an external thread for connecting threadedly with an internal thread on the front portion 242 of the second circumferential wall 240. A tubular coupler 270 is disposed between the slider 24 and the screw orientation guide member 25, and connects removably the rear section 254 of the third circumferential wall 252 to the front portion 242 of the second circumferential wall 240. The tubular coupler 270 has a fourth circumferential wall 272 with a rear part 275 formed with an external thread for connecting threadedly with the external thread on the the front portion 242 of the second circumferential wall 240, and a front part 276 formed with an internal thread for connecting threadedly with the external thread on the rear section 254 of the third circumferential wall 252. The tubular coupler 270 is formed with an axially extending slot 271 that is registry with one of the slots 245 in the tubular slider 24, and adapts the screw driving gun of this invention for use with screws of different lengths.

With this invention thus explained, it is apparent that numerous modifications and variations can be made without departing from the scope and spirit of this invention. It is therefore intended that this invention be limited only as indicated in the appended claims.

I claim:

1. A screw driving gun adapted for use with a screw feed belt that includes a belt body and a plurality of screws retained on the belt body, said screw driving gun comprising:

a gun housing;

a tubular barrel having a first circumstantial wall with a rear end mounted on said gun housing, and an opposite front end, said first circumferential wall defining a chamber in a longitudinal direction;

a tubular slider having a second circumferential wall with a rear portion that is coupled slidably to said front end of said barrel so as to be slidable relative thereto in the longitudinal direction, and a front portion that extends forwardly of said barrel, said front portion being formed with two opposing slots that extend in the longitudinal direction and that are adapted for passage of the belt body therethrough in order to register a selected one of the screws with said chamber of said barrel;

a screw driving shaft having a driven end and a turning bit opposite to said driven end, said screw driving shaft being accommodated in said chamber of said barrel such that said turning bit is extendible into said tubular slider, said screw driving shaft being rotatable axially such that said turning bit is adapted to drive rotatably the selected one of the screws;

a drive unit mounted in said gun housing and coupled to said driven end of said screw driving shaft so as to drive rotatably said screw driving shaft;

a tubular screw orientation guide member having a third circumferential wall with a rear section connected to said front portion of said second circumferential wall, and a front section formed with an abutting end for abutting against a work piece surface, said screw orientation guide member further having a plurality of holding units cooperatively confining a guide passage that extends in the longitudinal direction between said slider and said abutting end and that is tapered in the longitudinal direction to form a constricted front end proximate to said abutting end and a wider rear end opposite to said constricted front end, said holding units being adapted to provide radial inward holding forces on the selected one of the screws to prevent the selected one of the screws from deviating from the longitudinal direction when the selected one of the screws extends into the guiding passage while being driven rotatably into the work piece surface by said turning bit of said screw driving shaft wherein said rear section of said third circumferential wall is connected removably to said front portion of said second circumferential wall; and a tubular coupler, disposed between said slider and said screw orientation guide member, said tubular coupler connects removably said rear section of said third circumferential wall to said front portion of said second circumferential wall.

2. The screw driving gun as claimed in claim 1, wherein said rear section of said third circumferential wall is connected threadedly to said front portion of said second circumferential wall.

3. The screw driving gun as claimed in claim 1, wherein said tubular coupler has a fourth circumferential wall with a rear part connected threadedly to said front portion of said second circumferential wall, and a front part connected threadedly to said rear section of said third circumferential wall.

* * * * *